US006209783B1

(12) United States Patent
Collins

(10) Patent No.: US 6,209,783 B1
(45) Date of Patent: Apr. 3, 2001

(54) REINFORCED CARDBOARD BOX FOR STORAGE AND SHIPPING OF ELONGATED ITEMS AND ROLLED DOCUMENTS

(76) Inventor: Daren Collins, 10217 Sage Hill Way, Escondido, CA (US) 92026

( * ) Notice: Subject to any disclaimer, the term of this patent is extended or adjusted under 35 U.S.C. 154(b) by 0 days.

(21) Appl. No.: 09/134,414

(22) Filed: Aug. 13, 1998

(51) Int. Cl.[7] ..... B65D 5/22

(52) U.S. Cl. ..... 229/149; 229/164; 229/176; 229/178

(58) Field of Search ..... 229/149, 151, 229/164, 176, 178; 206/395, 446

(56) References Cited

U.S. PATENT DOCUMENTS

| | | | | |
|---|---|---|---|---|
| 1,946,516 | * | 2/1934 | Zalkind | 229/164 |
| 3,098,594 | * | 7/1963 | Williamson | 206/395 |
| 3,385,424 | * | 5/1968 | Thompson et al. | 229/178 |
| 3,889,868 | * | 6/1975 | Bruckner et al. | 229/164 |
| 4,257,550 | * | 3/1981 | Frohlicher | 229/149 |
| 4,437,713 | * | 3/1984 | Roach | 229/178 |
| 5,884,763 | * | 3/1999 | Ozawa | 206/395 |

FOREIGN PATENT DOCUMENTS

| | | | | |
|---|---|---|---|---|
| 40/4239443 | * | 8/1992 | (JP) | 206/395 |

* cited by examiner

*Primary Examiner*—Gary E. Elkins
(74) *Attorney, Agent, or Firm*—Beehler & Pavitt; David A. Belasco; William H. Pavitt

(57) ABSTRACT

A reinforced cardboard box for storage and shipping of elongated items and rolled documents is described. The box is formed from a single piece of cardboard and may be rapidly assembled without the use of tools. The box comprises an elongated rectangular bottom panel, first and second joined side panels, and first and second abutting top panels foldably joined to the side panels and constructed to form a center top closure for the box. The second top panel includes a series of tab openings. The center closure permits the finished box to be sealed by an automated tape machine. A reinforcing rib panel, having a series of bendable tab elements extending from an elongated edge, is foldably joined to the second top panel. The bottom panel has a pair of abutting end panels foldably joined to either end. The second side panel has a pair of outer side end panels foldably joined to either end and a pair of inner side end panels foldably joined to the outer side end panels. A pair of top reinforcing extensions are foldably joined to the inner side end panels of the abutting end panels. A pair of rounded closing end panels are foldably joined to either end of the first top panel. A closing member may extend from the distal edge of the first top panel. The second top panel may include an opening sized, shaped and located to receive the closing member. In use, the side panels are folded inwardly from the bottom panel and the inner side end panels are folded over the abutting end panels to form a receiving pocket for the rounded closing end panels between the inner and outer side end panels. Next the reinforcing rib panel is folded over the top reinforcing extensions and secured to the second top panel by means of the bendable tab elements and the top panels are folded inwardly. The rounded closing end panels are then inserted into the receiving pockets, the closing member is inserted into the closing member opening and the box is taped closed.

18 Claims, 6 Drawing Sheets

REINFORCED CARDBOARD BOX FOR STORAGE AND SHIPPING OF ELONGATED ITEMS AND ROLLED DOCUMENTS

FIELD OF INVENTION

The invention pertains to a cardboard box construction. More particularly, the invention relates to a box construction adapted for storage and shipping of items that must be protected from crushing, folding or bending forces.

BACKGROUND OF THE INVENTION

Various types of cardboard boxes, tubes and containers have been devised to protect elongated articles and rolled documents during shipment.

U.S. Pat. No. 2,075,679, issued to Weber, describes an elongated double-paneled container formed of cardboard having an edge closure that is sealed with adhesive tape. U.S. Pat. No. 3,249,284, issued to Wood, discloses a paperboard wrap-around package with a joint in the middle of one side. The joint includes a series of interlocking hooks and slots. U.S. Pat. No. 1,449,468, issued to Walter, describes a heavy-weight box or tube formed of fiberboard for shipping heavy metal bars such as automobile bumpers. The container includes a flap extension and metal bands for securing closure. U.S. Pat. No. 4,236,740, issued to Sorenson et al., illustrates a paperboard file storage box formed from a single blank of cardboard. The file storage box includes a pair of reinforcing panels on either end that are secured to the box ends with tab elements that project through mating openings in end flaps that fold over the reinforcing panels.

An effective design for a shipping container for such items must necessarily be a compromise of various factors. It is an objective of the present invention that the container provide the required degree of protection from the forces encountered in transfeiring the container from one destination to another by means of automated package handling systems, trucks, automobiles and aircraft. It is a further objective that the container be light in weight to prevent excessive shipping costs. It is yet a further objective of the invention that the container is economical to produce and simple to assemble. It is a still further objective that the container provide a simple and effective means of being sealed and later opened.

While features disclosed in the prior art satisfy some of the objectives of the present invention, none of the inventions found include all of the requirements identified.

SUMMARY OF THE INVENTION

The present invention addresses all of the deficiencies of prior art reinforced cardboard boxes and satisfies all of the objectives described above. A reinforced cardboard box for storage and shipping of elongated items and rolled documents may be formed from a single blank of cardboard material comprising the following components.

A rectangular bottom panel having a pair of first and second opposed, parallel elongated side edges, the side edges defining the length of the panel and terminating in first and second opposed, parallel end edges. A pair of abutting bottom end panels that are joined to one of the opposed end edges of the bottom panel. A first side panel is joined to the first opposed edge of the bottom panel. The first side panel has a pair of first and second opposed, parallel edges coinciding in length with the length of the side edges of the bottom panel.

A second side panel is joined to the second opposed edge of the bottom panel. The second side panel has a pair of first and second opposed, parallel edges coinciding in length with the length of the side edges of the bottom panel. A pair of outer side end panels, each having an inner surface and an outer surface, are foldably joined to an end of the second side panel. The outer side end panels have a tab opening at the juncture of the outer side end panel with the second side panel.

A pair of inner side end panels, each having an inner surface and an outer surface, that are foldably joined to one of the outer side end panels. The inner side end panels have a bendable tab element extending outwardly beyond the distal end of the panel. Each of the tab elements is sized, shaped and located to engage tab openings at the juncture of one of the outer side end panels with the second side panel. The tab openings are engaged when the outer side end panel is folded upwardly and the inner side end panel is folded downwardly over an end of the abutting bottom end panel.

A pair of receiving pockets are formed between the inner surface of the outer side end panels and the inner surface of the inner side end panel when the inner side end panel is folded over the outer side end panel.

A first top panel forms a first portion of a top closure. The first top panel has a first pair and a second pair of opposed, parallel edges, the first pair being of an elongated length. A first, elongated parallel edge is joined to an elongated edge of the first side panel.

A pair of rounded closing end panels, each being joined to the second pair of opposed, parallel edges of the first top panel at a score line. The score line allows the closing end panel to be folded inwardly at a right angle to the first top panel. The rounded closing end panels are adapted to be received in the receiving pockets.

A second top panel forms a second portion of the top closure. The second top panel has a first pair and a second pair of opposed, parallel edges, the first pair being of an elongated length. A first elongated, parallel edge is joined to an elongated edge of the second side panel. The second top panel has a plurality of tab openings at the juncture of the second side panel and the second top panel.

Each of the inner side end panels has a first and second pair of opposed, parallel edges. The first pair of parallel edges includes the bendable tab element and the juncture between the inner side end panel and the outer side end panel. The second pair of parallel edges is normal to the first pair of parallel edges and includes a first edge and a second edge. The second edge is collinear with the juncture between the second side panel and the second top panel.

A reinforcing rib panel is joined to an elongated edge of the second top panel. The rib panel has a plurality of bendable tab elements extending from its distal edge. The tab elements are sized, shaped and disposed to engage the openings in the second top panel when the rib panel is folded inwardly toward the second top panel.

A pair of top reinforcing extensions are provided, each having a first edge collinear with the juncture of the second side panel and the second top panel and a parallel second edge. A third edge is normal to the first edge and is collinear with the distal end of the inner side end panel with a fourth edge parallel to the third edge. Each of the extensions is joined to the second edge of the second pair of opposed, parallel edges of the inner side end panels. The extensions are further foldable inwardly from the inner side end panels to provide a means for constraining the second top panel in orthogonal orientation to the second side panel when the second top panel is folded inwardly and the rib panel is folded over the reinforcing extension.

In variation of the invention a closing member extends from a second elongated edge of the first pair of opposed parallel edges of the first top panel. The closing member has a score line spaced from and parallel to the second edge of the first top panel, the score line is located to coincide with the juncture of the second top panel and the second side panel.

The second top panel includes a closing member opening. The closing member opening is sized, shaped and located to accommodate the closing member that is joined to the first top panel. The portion of the member extending beyond the score line is located within the box when assembled.

In yet another variation of the invention, a reinforced cardboard box for storage and shipping of elongated items and rolled documents further comprises the following components. A pair of enlarged, rounded closing end panels that are foldably joined to one of the second pair of parallel edges of the first top panel. Each of the closing end panels has a length at its joined edge approximately equal to twice the distance between the first pair of parallel edges of the first top panel.

A first reinforcing triangular panel is provided that extends, at an acute angle, from the distal end of the joined edge of the enlarged rounded closing panel to the distal edge of the first pair of parallel edges of the first top panel. A pair of triangular relief notches are formed at the second pair of parallel edges of the second top panel. The relief notches are sized, shaped and located to receive the first reinforcing triangular panels of the first top panel when the box is closed.

In a further variation of the invention, a reinforced cardboard box for storage and shipping of elongated items and rolled documents further comprises the following components. A pair of second reinforcing triangular panels that are joined to the second edges of the top reinforcing extension and foldably joined to the second edge of the second pair of opposed parallel edges of the inner side end panels.

In still another variation of the invention the first and second top reinforcing extensions each have first and second opposed, parallel side edges and third and fourth opposed, parallel end edges, normal to the first and second edges. The first top reinforcing extension is foldably joined at its fourth edge to the distal edge of the first abutting end panel and the second top reinforcing extension is foldably joined at its third edge to the distal edge of the second abutting end panel.

To assemble the reinforced cardboard box, first and second abutting end panels are folded inwardly from the bottom panel. Next, the second side panel is folded inwardly from the bottom panel. Then, the first and second outside end panels are folded inwardly from the second side panel and the first and second inner side end panels are folded inwardly from the first and second outer side end panels and over the first and second abutting end panels. This allows the first and second bendable end tab elements to engage the first and second end tab openings.

Next, the first and second top reinforcing extensions are folded inwardly from the first and second abutting end panels. Then, the second top panel is folded inwardly from the second side panel and the reinforcing rib panel is folded over the first and second top reinforcing extensions and inwardly from the second top panel. This allows the side tab elements to engage the side tab openings in the second side panel, thereby securing bottom panel, second side panel and second top panel in orthoganal relation to one another to form an open-topped elongated container.

To form the closed container, the first and second rounded closing end panels are folded inwardly from the first top panel. Next, the first side panel is folded inwardly from the bottom panel and the first top panel is folded inwardly from the first side panel. Then, the first and second rounded closing end panels are received in the first and second receiving pockets, forming a closed elongated container. The first and second top panels may be secured with tape.

DESCRIPTION OF THE PREFERRED EMBODIMENT

Figure 1:
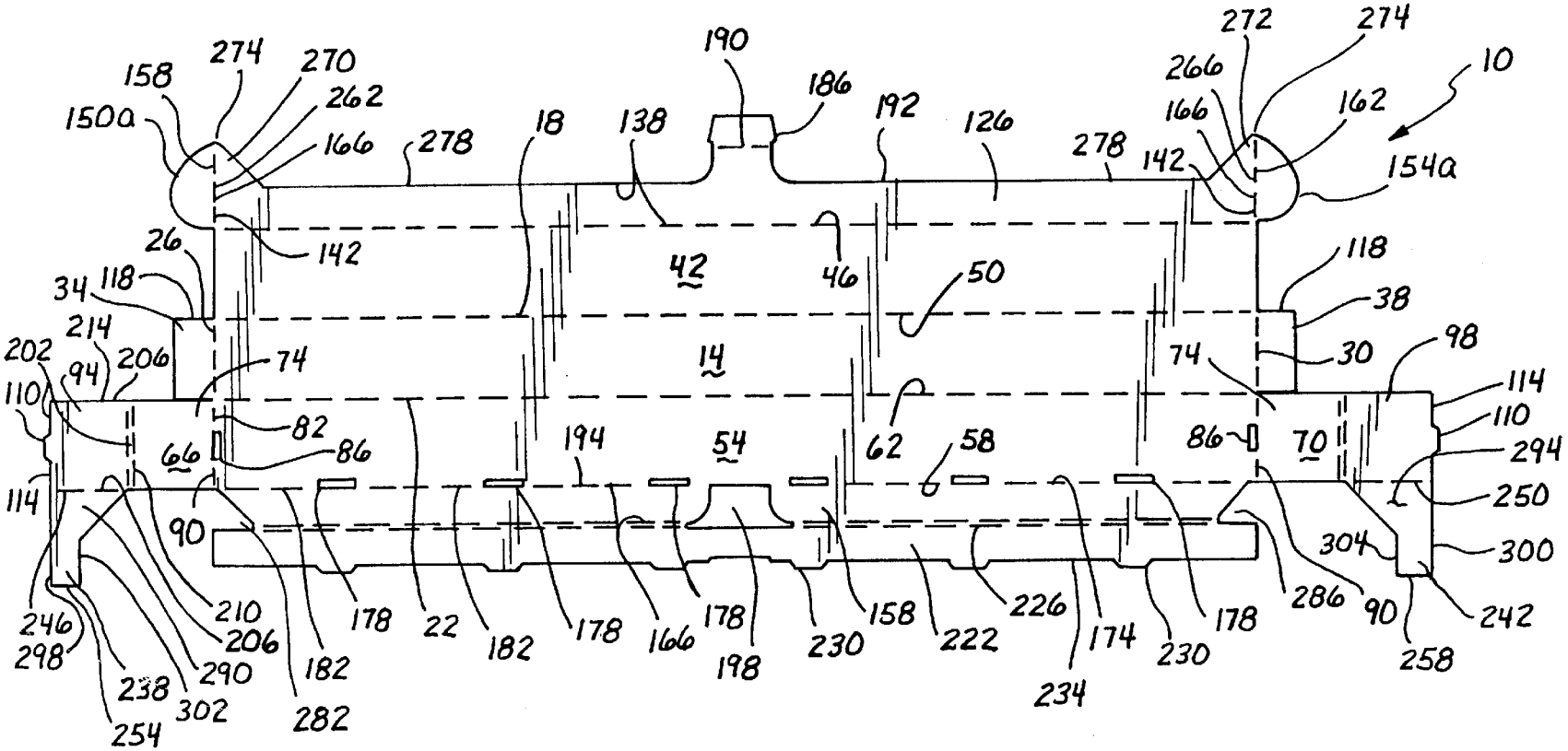
FIG. 1 is a plan view of the preferred embodiment of the invention.

FIG. 1 illustrates a die-cut blank for a reinforced cardboard box 10 for storage and shipping of elongated items and rolled documents. As shown in FIGS. 1–5, the invention comprises the following components.

A rectangular bottom panel 14 having a pair of first 18 and second 22 opposed, parallel elongated side edges, the side edges 18, 22 defining the length of the panel 14 and terminating in first 26 and second 30 opposed, parallel end edges. A pair of abutting bottom end panels 34, 38 that are joined to one of the opposed end edges 26, 30 of the bottom panel 14. A first side panel 42 is joined to the first opposed edge 18 of the bottom panel 14. The first side panel 42 has a pair of first 46 and second 50 opposed, parallel edges coinciding in length with the length of the side edges 18, 22 of the bottom panel 14.

A second side panel 54 is joined to the second opposed edge 22 of the bottom panel 14. The second side panel 54 has a pair of first 58 and second 62 opposed, parallel edges coinciding in length with the length of the side edges 18, 22 of the bottom panel 14. A pair of outer side end panels 66, 70, each having an inner surface 74 and an outer surface 78, are foldably joined to an end 82 of the second side panel 54. The outer side end panels 66, 70 have a tab opening 86 at the juncture 90 of the outer side end panel 66, 70 with the second side panel 54.

A pair of inner side end panels 94, 98 are provided, each having an inner surface 102 and an outer surface 106, that are foldablyjoined to one of the outer side end panels 66, 70. The inner side end panels 94, 98 have a bendable tab element 110 extending outwardly beyond the distal end 114 of the panel 94, 98. Each of the tab elements 110 is sized, shaped and located to engage tab openings 86 at the juncture 90 of one of the outer side end panels 66, 70 with the second side panel 54. The tab openings 86 are engaged when the outer side end panel 66, 70 is folded upwardly and the inner side end panel 94, 98 is folded downwardly over an end 118 of the abutting bottom end panel 34, 38.

Figure 2:
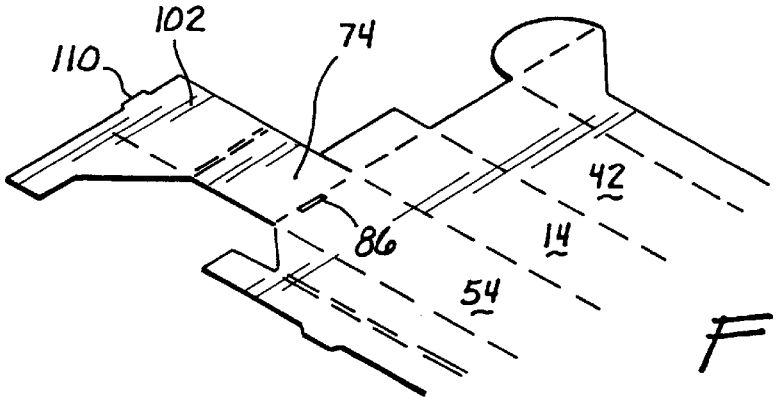
FIG. 2 is a perspective view of one end of the FIG. 1 embodiment.
Figure 3:
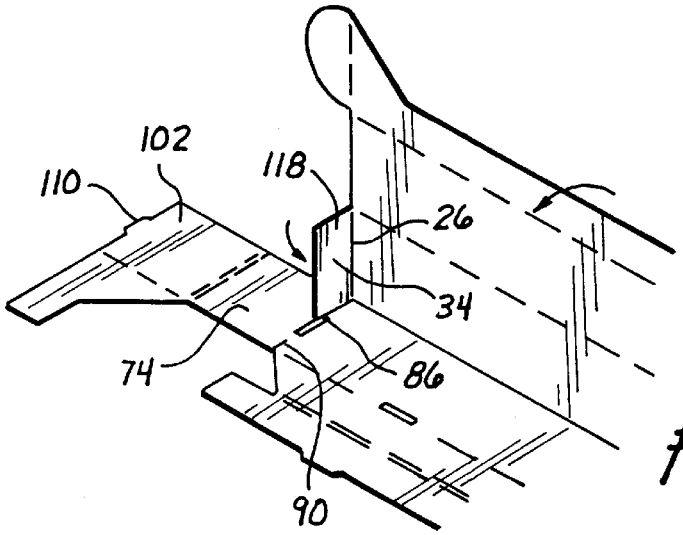
FIG. 3 is a perspective view of one end of the FIG. 1 embodiment illustrating the bottom panel folded at a right angle to the second side panel and the abutting end panel folded at a right angle to the bottom panel.
Figure 4:
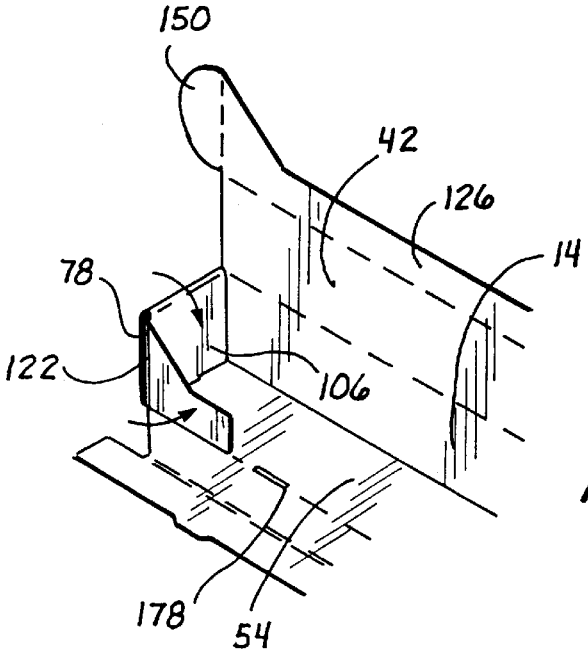
FIG. 4 is a perspective view of one end of the FIG. 1 embodiment illustrating the inner side end panel folded over the abutting end panel and the top reinforcing extension folded at a right angle to the inner side end panel.

As shown in FIGS. 2–4, a pair of receiving pockets 122 are formed between the inner surface 74 of the outer side end panel 66, 70 and the inner surface 102 of the inner side end panel 94, 98 when the inner side end panel 94, 98 is folded over the outer side end panel 66, 70.

As shown in FIGS. 1 and 5–7, a first top panel 126 forms a first portion 130 of a top closure 134. The first top panel 126 has a first pair 138 and a second pair 142 of opposed, parallel edges, the first pair 138 being of an elongated length. A first elongated, parallel edge 146 is joined to an elongated edge 46 of the first side panel 42.

Figure 1A:
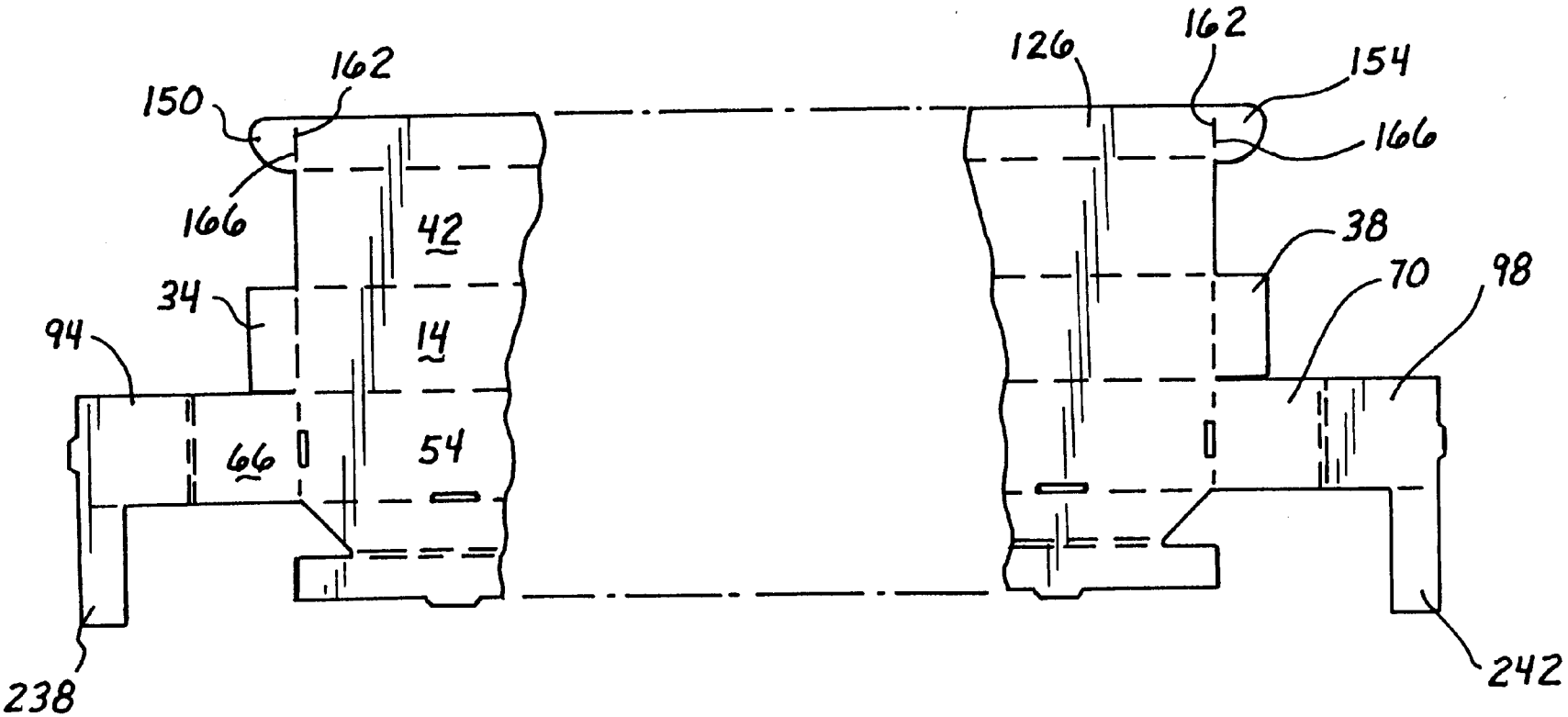
FIG. 1*a* is a partial plan view of a second embodiment of the invention, said embodiment lacking the enlarged, rounded closing end panels.
Figure 5:
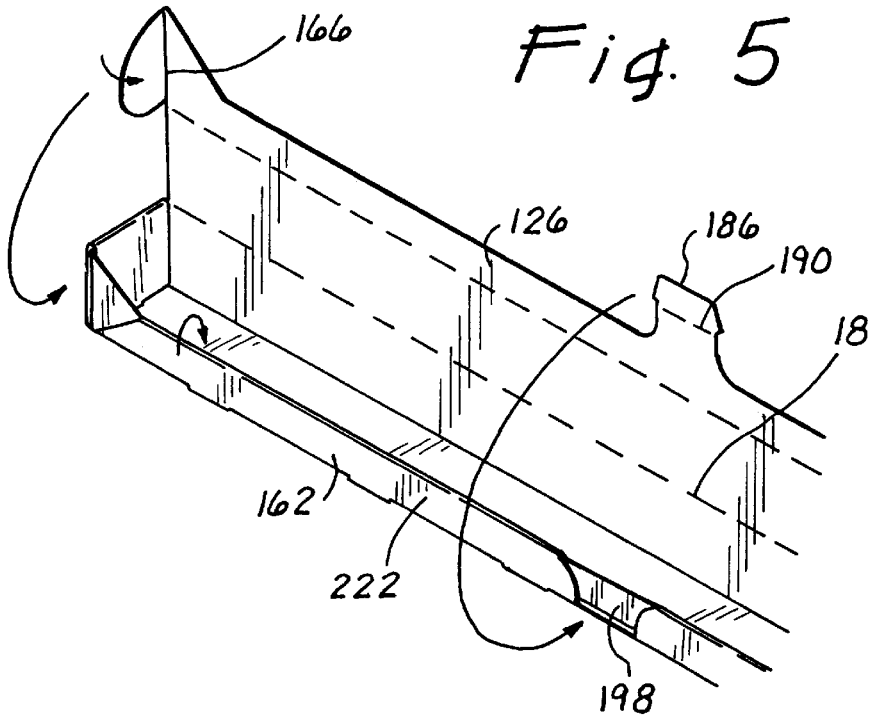
FIG. 5 is an extended perspective view of one end of the FIG. 1 embodiment illustrating the reinforcing rib panel folded over the top reinforcing extension and the rounded closing end panel folded at a right angle to the first top panel.

As shown in FIG. 1*a,* a pair of rounded closing end panels 150, 154, each being joined to the second pair 158, 162 of opposed, parallel edges of the first top panel 126 at a score line 166. The score line 166 allows the closing end panel 150, 154 to be folded inwardly at a right angle to the first top panel 126. The rounded closing end panels 150, 154 are adapted to be received in the receiving pockets 122 (FIG. 5).

As shown in FIGS. 1 and 5–7, a second top panel 158 forms a second portion 162 of the top closure 134. The second top panel 158 has a first pair 166 and a second pair 170 of opposed, parallel edges, the first pair 166 being of an elongated length. A first elongated, parallel edge 174 is joined to an elongated edge 58 of the second side panel 54. The second top panel 158 has a plurality of tab openings 178 at the juncture 182 of the second side panel 54 and the second top panel 158.

As shown in FIGS. 1–5, each of the inner side end panels 94, 98 have a first 202 and second 206 pair of opposed, parallel edges. The first pair of parallel edges 202 includes the bendable tab element 110 and the juncture 210 between the inner side end panel 94, 98 and the outer side end panel 66, 70. The second pair of parallel edges 206 is normal to the first pair 202 of parallel edges and includes a first edge 214 and a second edge 218. The second edge 218 is collinear with the juncture 182 between the second side panel 54 and the second top panel 158.

A reinforcing rib panel 222 is joined to an elongated edge 226 of the second top panel 158. The rib panel 222 has a plurality of bendable tab elements 230 extending from its distal edge 234. The tab elements 230 are sized, shaped and disposed to engage the openings 178 in the second top panel 158 when the rib panel 222 is folded inwardly toward the second top panel 158.

A pair of top reinforcing extensions 238, 242 are provided, each having a first edge 246, 250 collinear with the juncture 182 of the second side panel 54 and the second top panel 158 and a parallel second edge 254, 258. A third edge 298, 300 is normal to the first edge 246, 250 and is collinear with the distal end 114 of the inner side end panel 94, 98 with a fourth edge 302, 304 parallel to the third edge 298, 300. Each of the extensions 238, 242 is joined to the second edge 218 of the second pair 206 of opposed, parallel edges of the inner side end panels 94, 98. The extensions 238, 242 are further foldable inwardly from the inner side end panels 94, 98 to provide a means for constraining the second top panel 158 in orthogonal orientation to the second side panel 54 when the second top panel 158 is folded inwardly and the rib panel 222 is folded over the reinforcing extension 238, 242 (FIGS. 4–5).

In a variation of the invention a closing member 186 extends from a second elongated edge 192 of the first pair 138 of opposed, parallel edges of the first top panel 126. The closing member 186 has a score line 190 spaced from and parallel to the second edge 192 of the first top panel 126, the score line 190 is located to coincide with the juncture 194 of the second top panel 158 and the second side panel 54.

Figure 6:
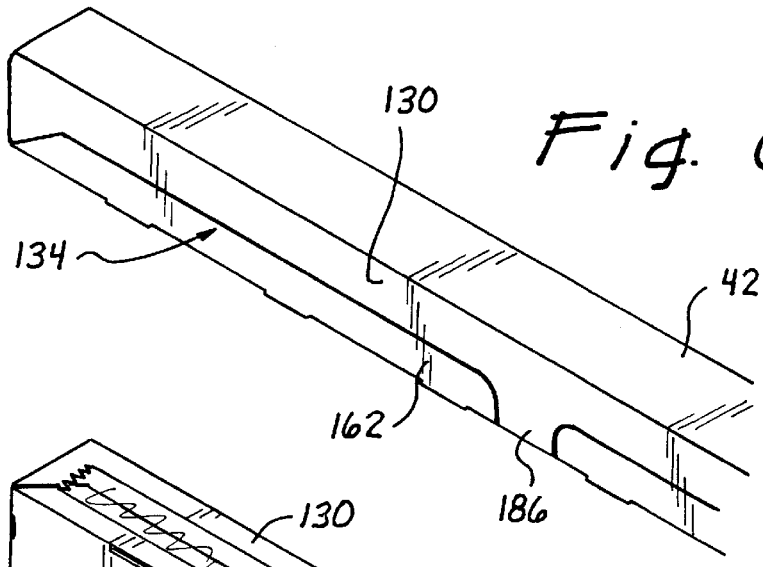
FIG. 6 is a perspective view of one end of the FIG. 1 embodiment illustrating the rounded closing end panel inserted into the receiving pocket and the closing member inserted into the closing member opening.
Figure 7:
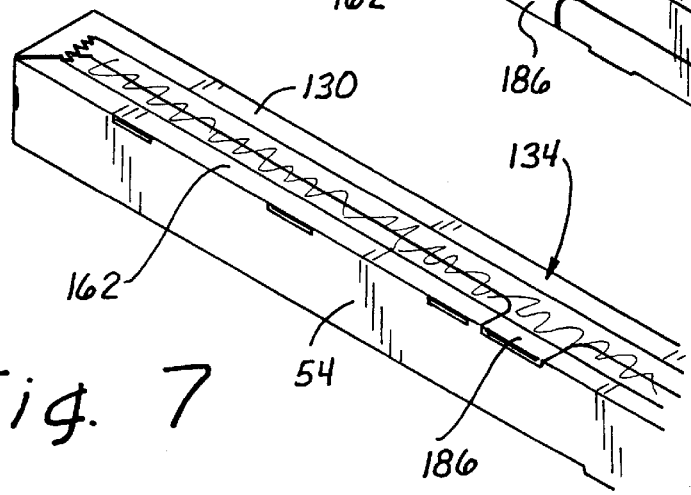
FIG. 7 is a perspective view of one end of the FIG. 1 embodiment illustrating the finished box rotated to rest upon the back panel and the top panels secured with packing tape.
Figure 8:
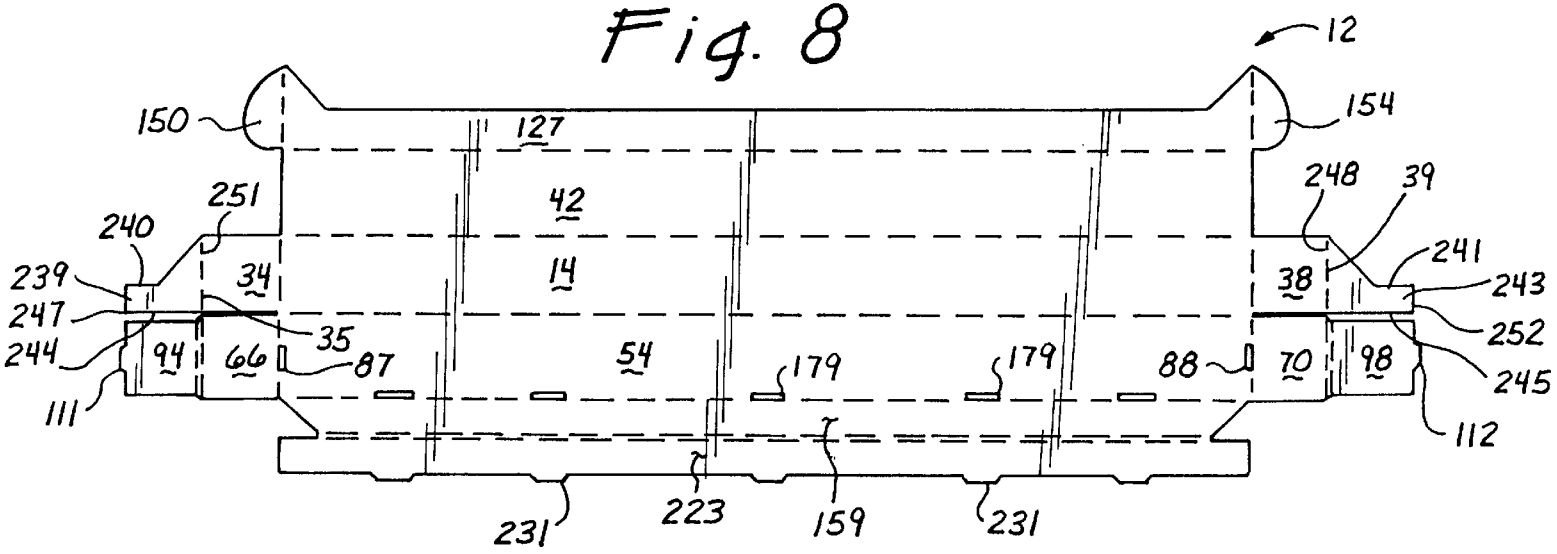
FIG. 8 is a plan view of a third embodiment of the invention, said embodiment lacking the closing member and closing member opening and having the first and second top reinforcing members foldably joined to the first and second abutting end panels.

The second top panel 158 includes a closing member opening 198. The closing member opening 198 is sized, shaped and located to accommodate the closing member 186 that is joined to the first top panel 126. The portion of the member 186 extending beyond the score line 190 is located within the box 10 when assembled (FIGS. 6–7).

In a variation of the invention, illustrated in FIGS. 1–5, a reinforced cardboard box for storage and shipping of elongated items and rolled documents 10 further comprises the following components. A pair of enlarged, rounded closing end panels 150*a,* 154*a* that are foldably joined to one of the second pair of parallel edges 142 of the first top panel 126. Each of the closing end panels 150*a,* 154*a* has a length at its joined edge 262, 266 approximately equal to twice the distance between the first pair of parallel edges 138 of the first top panel 126.

A first reinforcing triangular panel 270, 272 is provided that extends, at an acute angle, from the distal end 274 of the joined edge of the enlarged rounded closing panel 150*a,* 154*a* to the distal edge 278 of the first pair 138 of parallel edges of the first top panel 126. A pair of triangular relief notches 282, 286 are formed at the second pair 170 of parallel edges of the second top panel 158. The relief notches 282, 286 are sized, shaped and located to receive the first reinforcing triangular panels 270, 272 of the first top panel 126 when the box 10 is closed.

In a further variation of the invention, illustrated in FIGS. 1–5, a reinforced cardboard box for storage and shipping of elongated items and rolled documents 10 further comprises the following components. A pair of second reinforcing triangular panels 290, 294 that are joined to the fourth edges 302 of the top reinforcing extension 238, 242 and foldably joined to the second edge 218 of the second pair 206 of opposed parallel edges of the inner side end panels 94, 98.

In still another variation of the invention illustrated in FIGS. 8–14, the first 239 and second 243 top reinforcing extensions each have first 240, 241 and second 244, 245 opposed, parallel side edges and third 247, 248 and fourth 251, 252 opposed, parallel end edges, normal to the first 240, 241 and second 244, 245 edges. The first 239 top reinforcing extension is foldably joined at its fourth 251 edge to the distal edge 35 of the first 34 abutting end panel and the second 243 top reinforcing extension is foldably joined at its third 248 edge to the distal edge 39 of the second 38 abutting end panel.

Figure 10:
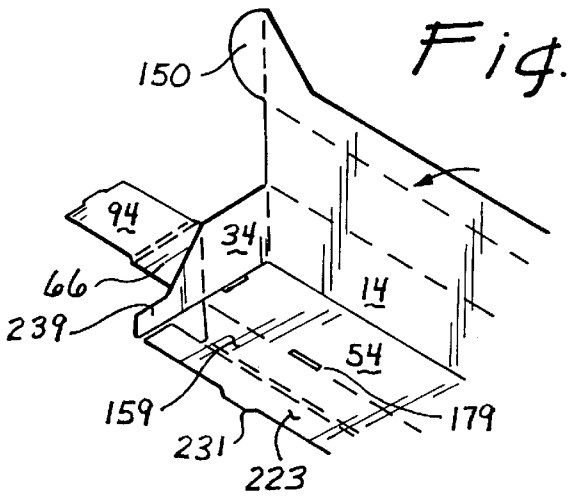
FIG. 10 is a perspective view of one end of the FIG. 8 embodiment illustrating the bottom panel folded at a right angle to the second side.
Figure 9:
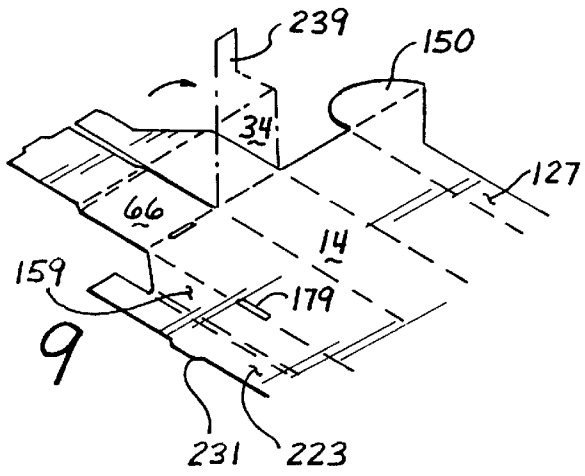
FIG. 9 is a perspective view of one end of the FIG. 8 embodiment illustrating the first abutting end panel folded inwardly from the bottom panel.
Figure 11:
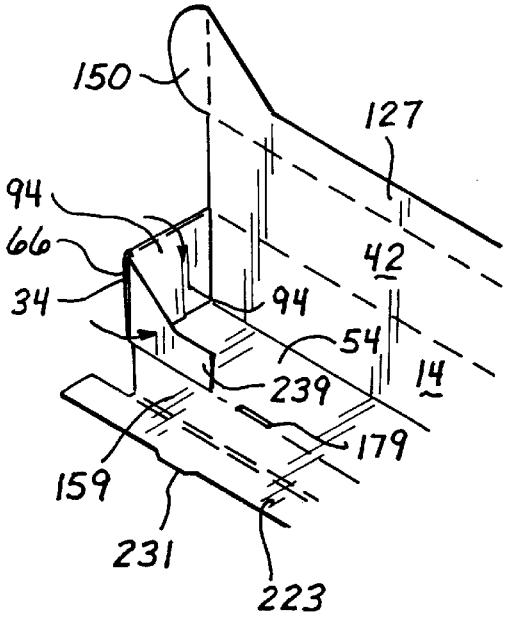
FIG. 11 is a perspective view of one end of the FIG. 8 embodiment illustrating the first top reinforcing extension folded inwardly from the first abutting end panel and the first outer side end panel folded inwardly from the second side panel and the first inner side end panel folded inwardly from the first outer side end panel and over the first abutting end panel.

To assemble the reinforced cardboard box 12, as shown in FIG. 9, first 34 and second **38*f* abutting end panels are folded inwardly from the bottom panel 14. Next, as shown in FIG. 10, the second side panel 54 is folded inwardly from the bottom panel 14. Then, as shown in FIG. 11, the first 66 and second 70 outside end panels are folded inwardly from the second side panel 54 and the first 94 and second 98 inner side end panels are folded inwardly from the first 66 and second 70 outer side end panels and over the first 34 and second 38 abutting end panels. This allows the first 111 and second 112 bendable end tab elements to engage the first 87 and second 88** end tab openings.

Figure 12:
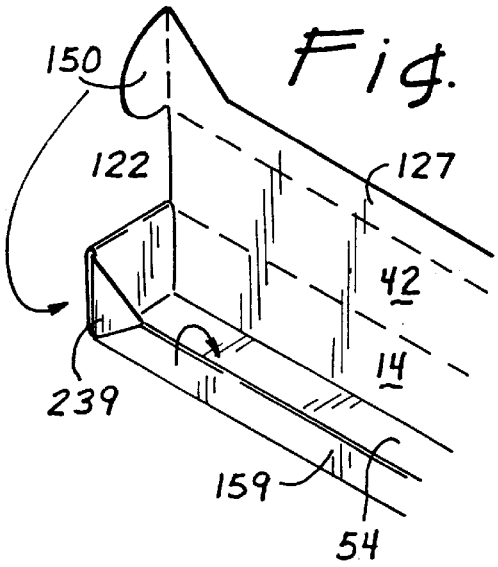
FIG. 12 is a perspective view of one end of the FIG. 8 embodiment illustrating the first rounded closing end panel folded inwardly from the first top panel and the second top panel folded inwardly from the second side panel and the reinforcing rib panel folded inwardly from the second top panel and over the first top reinforcing extension.

Next, the first 239 and second 243 top reinforcing extensions are folded inwardly from the first 34 and second 38 abutting end panels. Then, as shown in FIG. 12, the second top panel 159 is folded inwardly from the second side panel 54 and the reinforcing rib panel 223 is folded over the first 239 and second 243 top reinforcing extensions and inwardly from the second top panel 159. This allows the side tab elements 231 to engage the side tab openings 179 in the second side 54 panel, thereby securing bottom panel 14, second side panel 54 and second top panel 159 in orthoganal relation to one another to form an open-topped elongated container.

Figure 13:
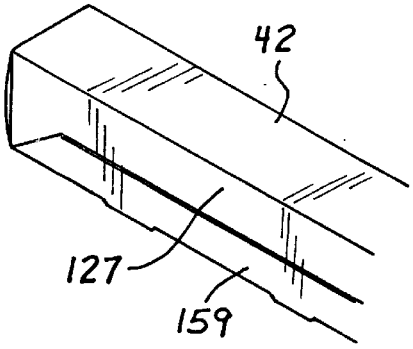
FIG. 13 is a perspective view of one end of the FIG. 8 embodiment illustrating the closed container with the first rounded closing end panel inserted into the first receiving pocket.
Figure 14:
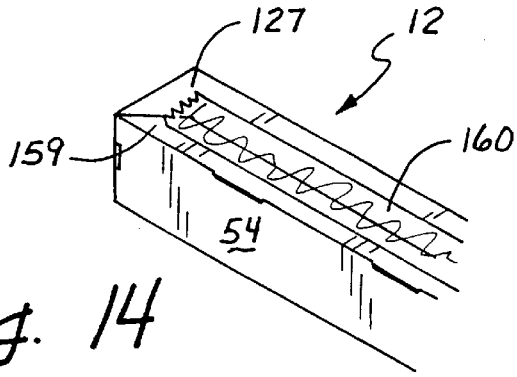
FIG. 14 is a perspective view of one end of the FIG. 8 embodiment illustrating the finished box rotated to rest upon the back panel and the top panels secured with packing tape.

To form the closed container 12, as shown in FIGS. 12–14, the first 150 and second 154 rounded closing end panels are folded inwardly from the first top panel 127. Next, the first side panel 42 is folded inwardly from the bottom panel 14 and the first top panel 127 is folded inwardly from the first side panel 42. Then, the first 150 and second 154 rounded closing end panels are received in the first and second receiving pockets 122, forming a closed elongated container 12. The first 127 and second 159 top panels may be secured with tape 160 as shown in FIG. 14.

What is claimed is:

1. A reinforced cardboard box for storage and shipping of elongated items and rolled documents, comprising:

a bottom panel, first and second opposed side panels, first and second abutting top panels and a reinforcing rib panel, each of said panels being substantially rectangular in shape and having opposed longitudinal and transverse edges, said longitudinal edges being of an elongated length, said side panels being foldably joined at their lower longitudinal edges to the bottom panel and foldably joined at their upper longitudinal edges to said first and second abutting top panels to the form an elongated box, said box having a substantially rectangular cross section, said rib panel being foldably joined to the second abutting top panel;

a pair of abutting bottom end panels, each of said bottom end panels being joined to a transverse edge of the bottom panel;

a pair of outer side end panels, each of said outer side end panels having an inner surface and an outer surface and being joined to the transverse edge of the second side panel, said side end panels having a tab opening therethrough, said opening being disposed between the outer side end panel and the second side panel;

a pair of inner side end panels, each of said inner side end panels having an inner surface and an outer surface and being foldably joined to said outer side end panels, each of said inner side end panels having a bendable tab element extending from its distal end, said tab element being sized, shaped and disposed to engage the opening in the outer side end panel when the outer side panel is folded upwardly and the inner side panel is folded downwardly over the abutting bottom end panel;

each of said inner side end panels having a first pair and a second pair of opposed, parallel edges, said second pair of parallel edges including a first edge and a second edge, said second edge being collinear with the juncture between the second side panel and the second top panel;

a pair of receiving pockets formed between the inner surface of the outer side end panel and the inner surface of the inner side end panel;

a pair of rounded closing end panels, each of said closing end panels being joined to the transverse edges of the first top panel along a score line, said score line allowing the closing end panel to be folded inwardly at a right angle to the first top panel, each of said rounded closing end panels being configured to be received in one of the receiving pockets;

a closing member, said closing member being joined to a distal longitudinal edge of the first top panel;

said closing member having a score line spaced from and parallel to the distal edge of the first top panel, said score line being disposed to coincide with the juncture of the second top panel and the second side panel when said panels are folded to form a box;

said second top panel having a plurality of tab openings therethrough, said tab openings being disposed along the juncture of the second side panel and the second top panel;

said second top panel having a closing member opening therethrough, said closing member opening being sized, shaped and disposed to accommodate the closing member, the portion of said member extending beyond the score line of the member being disposed within the box when assembled;

said rib panel being joined to a longitudinal edge of the second top panel, said rib panel having a plurality of tab projections extending from its distal edge, said tab projections being sized, shaped and disposed to engage the openings in the second top panel when the rib panel is folded inwardly toward the second top panel; and a pair of top reinforcing extensions, each of said extensions having a first edge collinear with the juncture of the second side panel and the second top panel, a parallel second edge, a third edge normal to the first edge, said third edge being collinear with the distal end of the inner side end panel and a fourth edge parallel to the third edge, said extensions being joined to the second edge of the second pair of opposed, parallel edges of the inner side end panels, said extensions further being foldable inwardly from the inner side end panels to provide a means for constraining the second top panel in orthogonal orientation to the second side panel when the second top panel is folded inwardly and the rib panel is folded over the reinforcing extension.

2. A one-piece, planar, cardboard blank for forming the reinforced cardboard box of claim 1.

3. A reinforced cardboard box for storage and shipping of elongated items and rolled documents as described in claim 1, further comprising:

a pair of enlarged rounded closing end panels, each being foldably joined to one of the transverse edges of the first abutting top panel, said closing end panels having a length at a joined edge approximately equal to twice the distance between the first pair of parallel edges of the first top panel;

a first reinforcing triangular panel, said triangular panel extending from the distal end of the joined edge of the enlarged rounded closing end panel to the longitudinal edge of the first top panel at an acute angle; and a pair of triangular relief notches formed at the transverse edges of the second top panel, said relief notches being sized, shaped and located to receive the first reinforcing triangular panels of the first top panel when the box is closed.

4. A one-piece, planar, cardboard blank for forming the reinforced cardboard box of claim 3.

5. A reinforced cardboard box for storage and shipping of elongated items and rolled documents as described in claim 3, further comprising a pair of second reinforcing triangular panels, each of said second triangular panels being joined to the fourth edge of the top reinforcing extension and foldably joined to the second edge of the second pair of opposed parallel edges of the inner side end panels.

6. A one-piece, planar, cardboard blank for forming the reinforced cardboard box of claim 5.

7. A reinforced cardboard box for storage and shipping of elongated items and rolled documents, comprising:

a rectangular bottom panel having a pair of first and second opposed, parallel elongated side edges, said side edges defining the length of the panel and terminating in first and second opposed, parallel end edges;

a pair of abutting bottom end panels, each of said bottom end panels being joined to one of the opposed end edges of the bottom panel;

a first side panel joined to the first opposed edge of the bottom panel, said first side panel having a pair of first and second opposed, parallel edges coinciding in length with the length of the side edges of the bottom panel;

a second side panel joined to the first opposed edge of the bottom panel, said second side panel having a pair of first and second opposed, parallel edges coinciding in length with the length of the side edges of the bottom panel;

a pair of outer side end panels, each of said outer side end panels having an inner surface and an outer surface and being foldably joined to an end of the second side panel, said side end panels having a tab opening at the juncture of the outer side end panel with the second side panel;

a pair of inner side end panels, each of said inner side end panels having an inner surface and an outer surface and being foldably joined to one of said outer side end panels, each of said inner side end panels having a bendable tab element extending outwardly beyond the distal end of the panel, each of said tab element being sized, shaped and located to engage tab openings at the juncture of one of the outer side end panels with the second side panel when the outer side end panel is folded upwardly and the inner side end panel is folded downwardly over an end of the abutting bottom end panel;

a pair of receiving pockets formed between the inner surface of the outer side end panel and the inner surface of the inner side end panel when the inner side end panel is folded over the outer side end panel;

a first top panel for forming a first portion of a top closure, said first top panel having a first and second pair of opposed, parallel edges, said first pair being of an elongated length, a first elongated, parallel edge being joined to an elongated edge of the first side panel;

a pair of rounded closing end panels, each of said closing end panels being joined to the second pair of opposed, parallel edges of the first top panel at a score line, said score line allowing the closing end panel to be folded inwardly at a right angle to the first top panel, said rounded closing end panels being adapted to be received in the receiving pockets;

a second top panel for forming a second portion of the top closure, said second top panel having a first and second pair of opposed parallel edges, a first elongated, parallel edge being joined to an elongated edge of the second side panel;

said second top panel having a plurality of tab openings at the juncture of the second side panel and the second top panel;

a closing member, said closing member extending from a second elongated edge of the first pair of opposed parallel edges of the first top panel;

said closing member having a score line spaced from and parallel to the second edge of the first top panel, said score line located to coincide with the juncture of the second top panel and the second side panel;

said second top panel having a closing member opening therethrough, said closing member opening being sized, shaped and located to accommodate the closing member joined to the first top panel, the portion of said member extending beyond the score line of the member being disposed within the box when assembled;

each of said inner side end panels having a first and second pair of opposed, parallel edges, said first pair of parallel edges including the bendable tab element and the juncture between the inner side end panel and the outer side end panel, said second pair of parallel edges being normal to the first pair of parallel edges and including an first edge and a second edge, said second edge being collinear with the juncture between the second side panel and the second top panel;

a reinforcing rib panel joined to an elongated edge of the second top panel, said rib panel having a plurality of bendable tab elements extending from its distal edge, said tab elements being sized, shaped and disposed to engage the openings in the second top panel when the rib panel is folded inwardly toward the second top panel; and a pair of top reinforcing extensions, each of said extensions having a first edge collinear with the juncture of the second side panel and the second top panel, a parallel second edge, a third edge normal to the first edge, said third edge being collinear with the distal end of the inner side end panel and a fourth edge parallel to the third edge, each of said extensions being joined to the second edge of the second pair of opposed, parallel edges of the inner side end panels, said extensions further being foldable inwardly from the inner side end panels to provide a means for constraining the second top panel in orthogonal orientation to the second side panel when the second top panel is folded inwardly and the rib panel is folded over the reinforcing extension.

8. A one-piece, planar, cardboard blank for forming the reinforced cardboard box of claim 7.

9. A reinforced cardboard box for storage and shipping of elongated items and rolled documents as described in claim 7, further comprising:

a pair of enlarged rounded closing end panels each being foldably joined to one of the second pair of parallel edges of the first top panel, each of said closing end panels having a length at its joined edge approximately equal to twice the length of each of the second pair of parallel edges;

a first reinforcing triangular panel, said triangular panel extending from the distal end of the joined edge of the enlarged rounded closing panel to the distal edge of the first pair of parallel edges of the first top panel at an acute angle; and a pair of triangular relief notches formed at the second pair of parallel edges of the second top panel, said relief notches being sized, shaped and located to receive the first reinforcing triangular panels of the first top panel when the box is closed.

10. A one-piece, planar, cardboard blank for forming the reinforced cardboard box of claim 9.

11. A reinforced cardboard box for storage and shipping of elongated items and rolled documents as described in claim 9, further comprising a pair of second reinforcing triangular panels, each of said second triangular panels being joined to the fourth edge of the top reinforcing extension and foldably joined to the second edge of the second pair of opposed parallel edges of the inner side end panels.

12. A one-piece, planar, cardboard blank for forming the reinforced cardboard box of claim 11.

13. A reinforced cardboard box for storage and shipping of elongated items and rolled documents, comprising:

a rectangular bottom panel, said bottom panel having first and second opposed, elongated, parallel side edges of a first predetermined length and third and fourth opposed, parallel end edges of a second predetermined length normal to the first and second edges;

first and second abutting bottom end panels, each of said bottom end panels having first and second opposed, parallel side edges of a third predetermined length and third and fourth opposed, parallel end edges of the second predetermined length, normal to the first and second edges;

said first bottom end panel being foldably joined at its fourth edge to the third edge of the bottom panel;

said second bottom end panel being foldably joined at its third edge to the fourth edge of the bottom panel;

a first rectangular side panel, said first side panel having first and second opposed, elongated, parallel side edges of the first predetermined length and third and fourth opposed, parallel end edges of the third predetermined length, normal to the first and second edges;

said first side panel being foldably joined at its second edge to the first edge of the bottom panel;

a second rectangular side panel, said second side panel having first and second opposed, elongated, parallel side edges of the first predetermined length and third and fourth opposed, parallel end edges of the third predetermined length, normal to the first and second edges;

said second side panel being foldably joined at its first edge to the second edge of the bottom panel;

first and second end tab openings, each of said end tab openings disposed adjacent one of the third and fourth edges of the second side panel;

a plurality of side tab openings, each of said side tab openings disposed adjacent the second edge of the second side panel;

first and second outside end panels, each of said outside end panels having an inner surface, first and second opposed, parallel side edges of the third predetermined length and third and fourth opposed, parallel end edges of the second predetermined length, normal to the first and second edges;

said first outside end panel being foldably joined at its fourth edge to the third edge of the second side panel;

said second outside end panel being foldably joined at its third edge to the fourth edge of the second side panel;

first and second inside end panels, each of said inside end panels having an inner surface, first and second opposed, parallel side edges of the third predetermined length and third and fourth opposed, parallel end edges of the second predetermined length, normal to the first and second edges;

said first inside end panel being foldably joined at its fourth edge to the third edge of the first outside end panel;

said second inside end panel being foldably joined at its third edge to the fourth edge of the second outside end panel;

first and second bendable end tab elements, said first end tab element sized, shaped and disposed along the third edge of the first inside end panel so as to engage the first end tab opening, said second end tab element sized, shaped and disposed along the fourth edge of the second inside end panel so as to engage the second end tab opening;

first and second receiving pockets, said first receiving pocket formed between the inner surface of the first outer side end panel and the inner surface of the first inner side end panel, said second receiving pocket formed between the inner surface of the second outer side end panel and the inner surface of the second inner side end panel;

a first top panel for forming a first portion of a top closure, said first top panel having first and second elongated, opposed parallel side edges of the first predetermined length and third and fourth opposed, parallel end edges of a fourth predetermined length, normal to the first and second edges;

said first top panel being foldably joined at its second edge to the first edge of the first side panel;

first and second rounded closing end panels, each of said rounded closing end panels being foldably to one of the third and fourth edges of the first top panel at a score line, said score line allowing the first and second closing end panels to be folded inwardly at a right angle to the first top panel, said first and second closing end panels adapted to be received in one of the first and second receiving pockets;

a second top panel for formiing a second portion of the top enclosure, said second top panel having first and second elongated, opposed parallel side edges of the first predetermined length and third and fourth opposed, parallel end edges of a fifth predetermined length, normal to the first and second edges;

said second top panel being foldably joined at its first edge to the second edge of the second side panel;

a reinforcing rib panel, said reinforcing rib panel having first and second elongated, opposed parallel side edges of the first predetermined length and third and fourth opposed, parallel end edges of the fifth predetermined length, normal to the first and second edges;

said reinforcing rib panel being foldably joined at its first edge to the second edge of the second top panel and having a plurality of bendable side tab elements extending from its second edge, said side tab elements being sized, shaped, and disposed to engage the side tab openings in the second side panel when the rib panel is folded inwardly toward the second top panel;

first and second top reinforcing extensions, each of said top reinforcing extensions having first and second opposed, parallel side edges and third and fourth opposed, parallel end edges, one of which is of the fifih predetermined length, normal to the first and second edges;

said first top reinforcing extension being foldably joined at its fourth edge to the third edge of the first abutting end panel;

said second top reinforcing extension being foldably joined at its third edge to the fourth edge of the second abutting end panel;

whereby, when the first and second abutting end panels are folded inwardly from the bottom panel, the second side panel is folded inwardly from the bottom panel, and the first and second outside end panels are folded inwardly from the second side panel and the first and second inner side end panels are folded inwardly from the first and second outer side end panels and over the first and second abutting end panels, thereby allowing the first and second bendable end tab elements to engage the first and second end tab openings, the first and second top reinforcing extensions are folded inwardly from the first and second abutting end panels, the second top panel is folded inwardly from the second side panel, the reinforcing rib panel is folded over the first and second top reinforcing extensions and inwardly from the second top panel allowing the plurality of side tab elements to engage the plurality of side tab openings, thereby securing the bottom panel, second side panel and second top panel in orthoganal relation to one another, an open-topped elongated container may be formed; and whereby, when the first and second rounded closing end panels are folded inwardly from the first top panel, the first side panel is folded inwardly from the bottom panel, the first top panel is folded inwardly from the first side panel and the first and second rounded closing end panels are received in the first and second receiving pockets, a closed elongated container may be formed that may be easily sealed with tape.

14. A reinforced cardboard box for storage and shipping of elongated items and rolled documents as described in claim 13, further comprising third and fourth triangular reinforcing panels, each of said third and fourth triangular panels being joined to one of the first edges of the first and second top reinforcing extensions and foldably joined to one of the third and fourth edges of the first and second abutting end panels.

15. A one-piece, planar, cardboard blank for forming the reinforced cardboard box of claim 14.

16. A one-piece, planar, cardboard blank for forming the reinforced cardboard box of claim 13.

17. A reinforced cardboard box for storage and shipping of elongated items and rolled documents as described in claim 13, further comprising:

first and second enlarged rounded closing end panels, each of said enlarged rounded closing end panels being foldably joined to one of the third and fourth edges of the first top panel at one of a first and second score lines, said score lines having a length equal the second predetermined length and allowing the first and second closing end panels to be folded inwardly at a right angle to the first top panel, said first and second closing end panels adapted to be received in one of the first and second receiving pockets;

first and second triangular reinforcing panels, each of said triangular panel extending from the distal end of one of the score to the first edge of the first top panel at an acute angle; and first and second triangular relief notches formed at the third and fourth edges of the second top panel, said relief notches being sized, shaped and located to receive the first reinforcing triangular panels of the first top panel when the box is closed.

18. A one-piece, planar, cardboard blank for forming the reinforced cardboard box of claim 17.

* * * * *